US005696061A

United States Patent [19]

Walsh

[11] Patent Number: 5,696,061

[45] Date of Patent: Dec. 9, 1997

[54] SELF-CLEANING POLYPROPYLENE FABRIC WEAVING LUBRICANT

[75] Inventor: William C. Walsh, Archbold, Ohio

[73] Assignee: BASF Corporation, Mount Olive, N.J.

[21] Appl. No.: 557,203

[22] Filed: Nov. 14, 1995

[51] Int. Cl.[6] ..... C10M 105/70

[52] U.S. Cl. ..... 508/268; 252/8.81; 252/8.84

[58] Field of Search ..... 508/268; 252/8.81, 252/8.84

[56] References Cited

U.S. PATENT DOCUMENTS

| | | | |
|---|---|---|---|
| 3,198,732 | 8/1965 | Olney | 252/8.9 |
| 3,357,919 | 12/1967 | Blake et al. | 252/88 |
| 3,420,050 | 1/1969 | Parsey et al. | 57/149 |
| 3,613,612 | 10/1971 | Kennedy | 112/410 |
| 3,919,097 | 11/1975 | Park | 252/8.9 |
| 4,191,656 | 3/1980 | Marshall | 252/8.6 |
| 4,324,720 | 4/1982 | Swihart | 252/8.9 |
| 4,390,591 | 6/1983 | Marshall et al. | 252/8.7 |
| 4,578,203 | 3/1986 | Franz et al. | 252/49.3 |
| 4,859,350 | 8/1989 | Gillberg-LaFore et al. | 252/8.9 |
| 4,915,855 | 4/1990 | Gillberg-LaFore et al. | 252/8.9 |
| 5,234,720 | 8/1993 | Neal et al. | 427/393.1 |
| 5,430,096 | 7/1995 | Hwang et al. | 324/602 |

FOREIGN PATENT DOCUMENTS

| | | |
|---|---|---|
| 2264083 | 3/1974 | France . |
| 1130555 | 10/1968 | United Kingdom . |
| 1230555 | 5/1971 | United Kingdom . |

OTHER PUBLICATIONS

International Search Report—PCT/EP 96/05009, Apr. 2, 1997.

*Primary Examiner*—Ellen M. McAvoy
*Attorney, Agent, or Firm*—George A. Gilbert

[57] ABSTRACT

Provided herein is a composition, system and method containing a hydrophobic lubricant and a water soluble solvent. The invention my also contain water. Specific solvents include akyl or alkoxy pyrrolidones such N-methyl-2-pyrrolidone which are added to or mixed with loom lubricators. Also provided is a method for inhibiting the increase in viscosity of lubricants used in polyolefin processing methods. Polyolefin compounds such as polyethylene, polypropylene and polybutylene are some of the compounds used in the invention. Provided are solutions, methods and systems used in manufacturing process that use polyolefins. The manufacturing processes include weaving, extruding and molding.

49 Claims, 4 Drawing Sheets

SELF-CLEANING POLYPROPYLENE FABRIC WEAVING LUBRICANT

FIELD OF THE INVENTION

This invention relates to compositions used to inhibit the increase in viscosity of lubricants used in manufacturing processes. This invention also relates to lubricants and cleaners used in the manufacture of polyolefin products. This invention particularly relates to the use of pyrrolidones as an additive to polyolefin processing hydrophobic lubricants.

BACKGROUND OF THE INVENTION

Lubricants or finishes are added to polyolefins during manufacturing processes to decrease the friction between the polyolefin and metal processing equipment. The decrease in the friction prevents the build-up of heat in the processes. For example, when polyethylene or polypropylene is molded into solid parts or extruded into either thick or thin films, release agents or "slips" agents are added to the polyolefin to prevent an increase in temperature when the polyolefin comes into contact with the equipment. This feature of the lubricant is useful for preventing material manufactured from polyolefins from being melted or torn.

Finishes or lubricants are used in various stages of processes that weave, spin or draw polyolefin strands into fabrics. For example, lubricants are added to fabric in processes where the fabric becomes a component of a finished good. Lubricants are also useful in processes where adhesives or coatings are applied to the fabric to aid in the adhesion of the coating or adhesive to the polypropylene. Because the lubricant prevents frictional heat build-up, the melting or tearing of the fabric is avoided.

A specific example of the use of lubricants to protect fabrics is in the manufacture of carpets. Polypropylene fiber is woven into fabrics that are used as the backing fabric for carpets. The fibers on the face of the carpet are tufted through a polypropylene fabric and an adhesive is applied to the back of the polypropylene/tufted fiber matrix to hold the fibers in place. High speed metal needles push the carpet fiber through the polypropylene fabric backing material causing the high speed needles to come into contact with the polypropylene filaments. Lubricants must be applied to the fiber or the needles will either break the filaments, which results in pieces of tuft continually falling off of the carpet; or, if the weave is tight, the filaments will break the tufting needles. The lubricant is normally applied to the polyolefin prior to the weaving processes.

One drawback in the use of lubricants in the above described processes is that excess lubricant causes a film to become deposited on various surfaces of the manufacturing equipment. For example, during the manufacture of carpets a film coats the surfaces of the loom. Another drawback is that the metal surfaces of the looms shave the polyolefin filaments to produce a fine polyolefin dust. This dust generally collects at the same areas of the loom where the lubricant film accumulates. The accumulation of the dust in the lubricant causes an increase in the viscosity of the lubricant and lowers its efficiency.

After continued use of the lubricant, it becomes saturated with the dust and a paste or gel is formed. The dust, film and paste accumulates in critical areas of the loom and contaminates the final woven fabric. Thus, workers must periodically clean the looms. To clean the looms, the workers generally dismantle the loom equipment and spray-dry it with hot water under high pressure to remove the undesirable material. The water may contain a surfactant. An alternative cleaning method is to spray-dry the equipment with an organic solvent (e.g., 140 Solvent or Naphtha 140).

These cleaning methods can take up to eight hours for each loom and each loom must be cleaned at least several times a year. Thus, the current cleaning procedures result in significant loom "down-time". Further, the use of solvents may create fire and other environmental hazards. Also, the cleaning solvents generally evaporate into the surrounding atmosphere resulting in a significant waste of material.

Thus, an object of the invention is to reduce industrial loom "down-time". Another object of the invention is to reduce or eliminate the exposure of workers to hazardous organic solvents. Yet another object of the present invention is to decrease the expense related to the waste of the solvents. These and other objects of the invention will become apparent from the following discussion.

SUMMARY OF THE INVENTION

Provided herein is a solution comprising a water soluble solvent and a hydrophobic lubricant. The hydrophobic lubricant further comprises a hydrophobic polyolefin processing lubricant. Also provided herein is a self-cleaning lubricant system comprising: (a) a hydrophobic polyolefin processing lubricant; (b) a water soluble solvent capable of inhibiting an increase in the viscosity of the lubricant; and (c) a polyolefin processing machine containing a polyolefin; wherein the lubricant and the solvent are mixed with the polyolefin in the machine. Further provided is a method for inhibiting an increase in viscosity in a mixture containing a polyolefin and a processing lubricant comprising: (a) adding a water soluble solvent to a polyolefin contained in a polyolefin processing machine wherein said solvent hinders the increase in viscosity of the hydrophobic lubricant; (b) adding said lubricant to said polyolefin contained in said processing machine.

Thus, the invention provides for a solution, system and a method that inhibits the build-up of undesirable pastes and other polyolefin particulate matter from accumulating in standard lubricants.

DETAILED DESCRIPTION OF THE INVENTION

Figure 1:
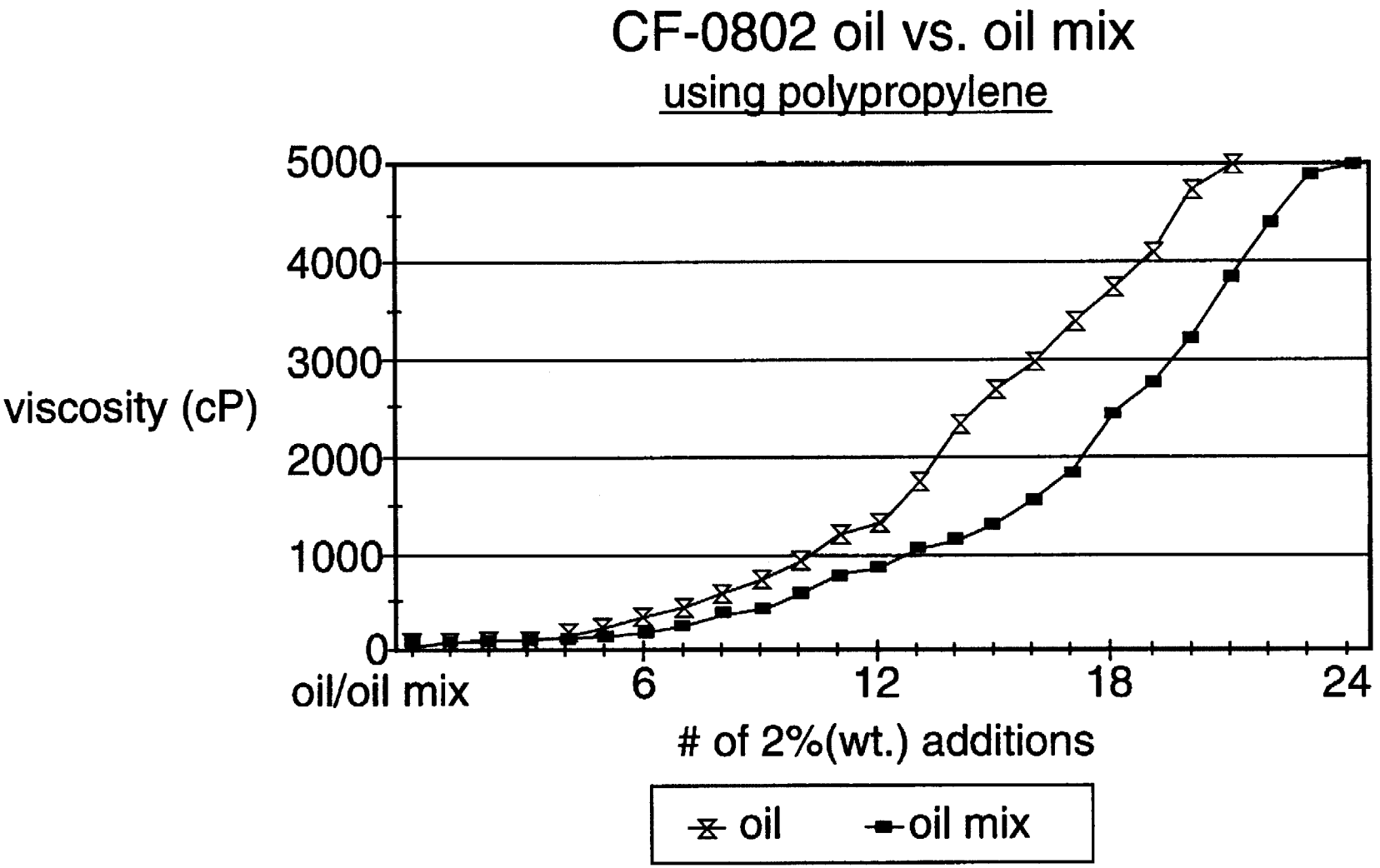
FIG. 1 is a graph depicting the viscosity of an embodiment of the present invention in the presence of polypropylene.

The lubricant solution and system comprises a hydrophobic lubricant and a water soluble component. Water may also be used as a component of the solution or system. Other components may also be used to carry out the invention such as organo siloxane or silicone compounds—e.g., compounds that increase the lubricating properties of the system. Other additional components that may be used to practice the invention include surface tension reducing agents such as surfactants or wetting agents that are normally soluble in either the water soluble solvent (or water) or the hydrophobic component.

The hydrophobic lubricant is preferably a polyolefin processing lubricant or a polyolefin fiber weaving lubricant. The lubricant can be a naturally occurring vegetable or seed oil such as, but not limited to, soybean oil, peanut oil, sunflower oil, canola oil, corn oil, or olive oil. The hydrophobic lubricant also includes epoxidized peanut or soybean oil or propoxylated oil. Preferred hydrophobic lubricants comprise polymers of ethylene oxide or propylene oxide. The most preferred lubricants for carrying out the invention are STANTEX® 0332 (ethoxylated vegetable oil based polypropylene fiber weaving lubricant manufactured by the Henkel Corporation), CF-0802 oil (a synthetic oil polymer of ethylene/propylene oxide manufactured by Henkel Corporation) and PM-003-10 (Henkel Corporation).

The water soluble solvent of the invention includes compounds selected form the group of alkyl or alkoxy substituted pyrrolidones. The preferred alkyl or alkoxy substituted pyrrolidone are selected from the group of compounds comprising 2-pyrrolidones such as N-methyl-2-pyrrolidone, N-cyclohexyl-2-pyrrolidone, N-ethyl-2-pyrrolidone, N-propyl-2-pyrrolidone, N-hydroxyethyl-2-pyrrolidone, N-hydroxypropyl-2-pyrrolidone or N-butyl-2pyrrolidone.

The water soluble solvent may also comprise an alcohol, a glycol or a propylene glycol. Other water soluble solvents that may be used in the invention include methyl, ethyl or propyl ethers. Representative compounds are butoxy ethanol, ethylene glycol mono methyl ether, ethylene glycol mono ethyl ether, ethylene glycol mono propyl ether, di-propylene glycol mono methyl ether, propylene glycol mono methyl ether, propylene glycol mono ethyl ether, propylene glycol mono butyl ether, di-propylene glycol mono ethyl ether, di-propylene glycol mono propyl ether, di-propylene glycol mono methyl ether, tri-propylene glycol mono methyl ethyl 1-mono propyl and mono butyl ethers.

Optionally, the water soluble solvent may comprise blends of two or more of the water soluble solvents. Similarly, the hydrophobic solvent may also comprise two or more hydrophobic solvents.

The amount of the components can vary from application to application and are readily determined by routine experimentation such as those performed in the experiments set out below. However, the water soluble solvent must be present in an amount that inhibits the increase of viscosity of the hydrophobic lubricant. The solvent may also be used to dissolve the hydrophobic lubricant. In one embodiment of the invention, the amount of hydrophobic lubricant ranges from about 10% to about 99% by weight and the water soluble component ranges from about 99% to about 1%. A preferred range comprises about 25% to about 76% of the hydrophobic lubricant and about 75 to 24% of the water soluble solvent. The most preferred range comprises about 55% to about 65% hydrophobic component and about 35% to about 45% water soluble component.

A preferred embodiment of the invention comprises water. In these embodiments, the amount, by weight, of the components ranges from about 25% to about 76% hydrophobic lubricant; about 40% to about 5% water; and about 40% to about 5% of the water soluble solvent. The preferred range comprises about 55% to about 65% by weight of the hydrophobic lubricant; about 10% to about 25% by weight water; and about 10% to about 25% by weight of the water soluble component. Preferably, the amount by weight of the water soluble solvent is about the same amount, by weight, as the amount of water present in the invention.

A preferred formulation of the present invention comprises about 17% of NMP; about 17% water; and about 66% of the hydrophobic lubricant PM-003-10 STANTEX®, wherein the total amount of the components, by weight, is 100%.

The solutions used to carry-out the invention are formed by mixing together the hydrophobic lubricant, the water soluble solvent and the water in a suitable container. Simple agitation (e.g., a propeller type of mixing blade operating at about 60 to 120 rpm) is adequate. The blending of the components is carried out at room temperature. When an alkyl or alkoxy pyrrolidone is present a sharp increase in temperature of the solution will occur.

While not being bound to any theory, it appears that hydrogen bonding occurs between the pyrrolidone compounds and water to create a large exotherm. As a result of this exotherm, a rise in the temperature of the solution can be expected. Depending on the amount of water and pyrrolidone present the temperature rise can range from 5° C. to 20° C. Although some hydrogen bonding occurs between the glycol or glycol ether constituents and water, no appreciable exotherm is observed when they are mixed together. The complexing of the hydrophobic lubricant with the water soluble solvent appears to interfere with the affinity of the polyolefin dust to be drawn to the hydrophobic lubricant. Inhibiting the affinity of the dust to be drawn to the hydrophobic lubricant allows the lubricant to remain a flowing liquid.

The present invention also provides a method for inhibiting the increase in viscosity of lubricants in processes that make products out of polyolefins. Examples of the preferred processes include the molding, extruding and weaving of polyolefins such as polyethylene, polypropylene and polybutylene. The invention provides a self-cleaning lubricant, system and method that allows for the continuous cleaning of manufacturing equipment such as looms. For example, the addition of NMP to a hydrophobic lubricant used to clean "gum" or "paste" build-up of polyolefins in processes such as molding, extruding or weaving, provides a self-cleaning solution which inhibits the formation of the "gum" or "paste".

The method can be used in processes where polypropylene is used to construct thin films which are used to make packaging materials such as food containing bags or trash bags. In one method, polyethylene is molded into containers for consumable liquid products such as plastic milk bottles and liquid detergent bottles. The present invention can also be used in applications where polyethylene and polypropylene are extruded into thick films (⅛ to one inch thick) to make construct/on materials such as fabricated holding tanks. These methods allow the lubricant to remain a flowing liquid at higher concentrations of polyolefin particulate by preventing the formation of gels or pastes.

One embodiment of the present invention involves a method wherein strands of polyolefin yarn are passed through a bath containing the lubricant. The lubricant and solvent are coated onto the strands of polyolefin yarn using a rotating "kiss roll" apparatus wherein the lubricant and the water soluble solvent are contained in a pan so that the yarn passes through the pan via a rotating apparatus traveling at speeds of hundreds of feet per minute.

Although the lubricant and the water soluble solvent can be added to the polyolefin directly as a mixture or by the addition of one material at a time, the preferred method comprises first mixing the hydrophobic lubricant with the water soluble solvent and then adding the mixture directly to the polyolefin yarn prior to the start of the weaving or spinning processes.

Accordingly, the current invention is an improvement over existing yarn processing lubricants and can also be used as a lubricant system for the processing of any polyolefin yarn or fiber.

The following examples are illustrative only and are not meant to limit the invention in any manner.

Example 1

Two hundred (200) grams of STANTEX® 0332 (ethoxylated vegetable oil based polypropylene fiber weaving lubricant; manufactured by HENKEL Corp.) and 200 grams of n-methyl-2-pyrrolidone (NMP) are added to a 600 ml beaker. The beaker was placed onto a magnetic stirring device and the speed was set at a medium setting. The two components were mixed for 5 minutes until a clear straw colored solution appeared. The mixing was performed at 24° C.

Example 2

One hundred (100) grams of NMP and approximately 2 grams of hard agglomerate residue taken form the metal surface of a polypropylene fabric weaving loom was added to a 250 ml beaker. The agglomerate was the result of the thickening of STANTEX® 0332 lubricating oil and polypropylene dust present on the woven fibers. The clumps of agglomerate began to fall apart immediately.

Example 3

One hundred and twenty (120) grams of STANTEX® 0332 oil and 40.0 grams of N-methyl-2-pyrrolidone were added to a 250 ml beaker to form a solution wherein the solution was stirred (magnetic stirring apparatus) at medium speed for about five minutes. Forty (40) grams of water was added to the solution. The temperature of the solution increased from 24° C. to 41° C. The solution was mixed for another five minutes. The solution was allowed to cool to 24° C.

A large sample of polypropylene dust (representative of the dust which accumulates on a polypropylene fiber) was obtained form a polypropylene fabric weaving mill. The polypropylene dust was added, in 2% increments, to samples of 100% STANTEX® 0332 oil and to the blend described above. The test was carded out at about 24° C. The viscosity of the samples were measured using a Brookfield Viscometer Model DV-II (Spindle SC4-34; Chamber 13R; and Speed 6). The results are listed in Table 1 and graphed in FIG. 1.

TABLE 1

| Sample Addition | 2% wt(g) pP | Oil/pP visc. (cP) | 2% wt(g) pP | Oil(mix)/pP visc.(cP) |
|---|---|---|---|---|
| Oil/oil mix | — | 180 | — | 120 |
| 1 | 1.0175 | 240 | 1.0341 | 200 |
| 2 | 1.0459 | 311 | 1.0211 | 270 |
| 3 | 1.0274 | 361 | 1.0133 | 301 |
| 4 | 1.0024 | 361 | 1.0133 | 301 |
| 5 | 1.0002 | 860 | 1.0533 | 501 |
| 6 | 1.0177 | 1160 | 1.0188 | 852 |
| 7 | 1.0133 | 1510 | 1.0136 | 1350 |
| 8 | 1.0171 | 1890 | 1.0319 | 1670 |
| 9 | 1.0026 | 2390 | 1.0477 | 2000 |
| 10 | 1.0166 | 3320 | 1.028 | 2780 |
| 11 | 1.0142 | 4090 | 1.0183 | 3190 |

TABLE 1-continued

| Sample Addition | 2% wt(g) pP | Oil/pP visc. (cP) | 2% wt(g) pP | Oil(mix)/pP visc.(cP) |
|---|---|---|---|---|
| 12 | 1.0137 | 5130 | 1.0189 | 3970 |
| 13 | 1.0452 | 6050 | 1.011 | 4740 |
| 14 | 1.0331 | 7050 | 1.0673 | 5740 |
| 15 | 1.0393 | 7800 | 1.0462 | 6410 |
| 16 | 1.0136 | 8850 | 1.021 | 7010 |
| 17 | 1.0457 | 10000 | 1.0717 | 7630 |
| 18 | — | — | 1.0004 | 8220 |
| 19 | — | — | 1.0091 | 9640 |
| 20 | — | — | 1.0235 | 10000 |

The results show that after 34% of the polypropylene dust was added to the 100% STANTEX® 0332 oil the mixture became a solid gel whereas the NMP/water/STANTEX® 0332 mixture was still a flowing liquid and did not form a solid gel until after 40% of the polypropylene dust was added to the mixture.

Example 4

Figure 2:
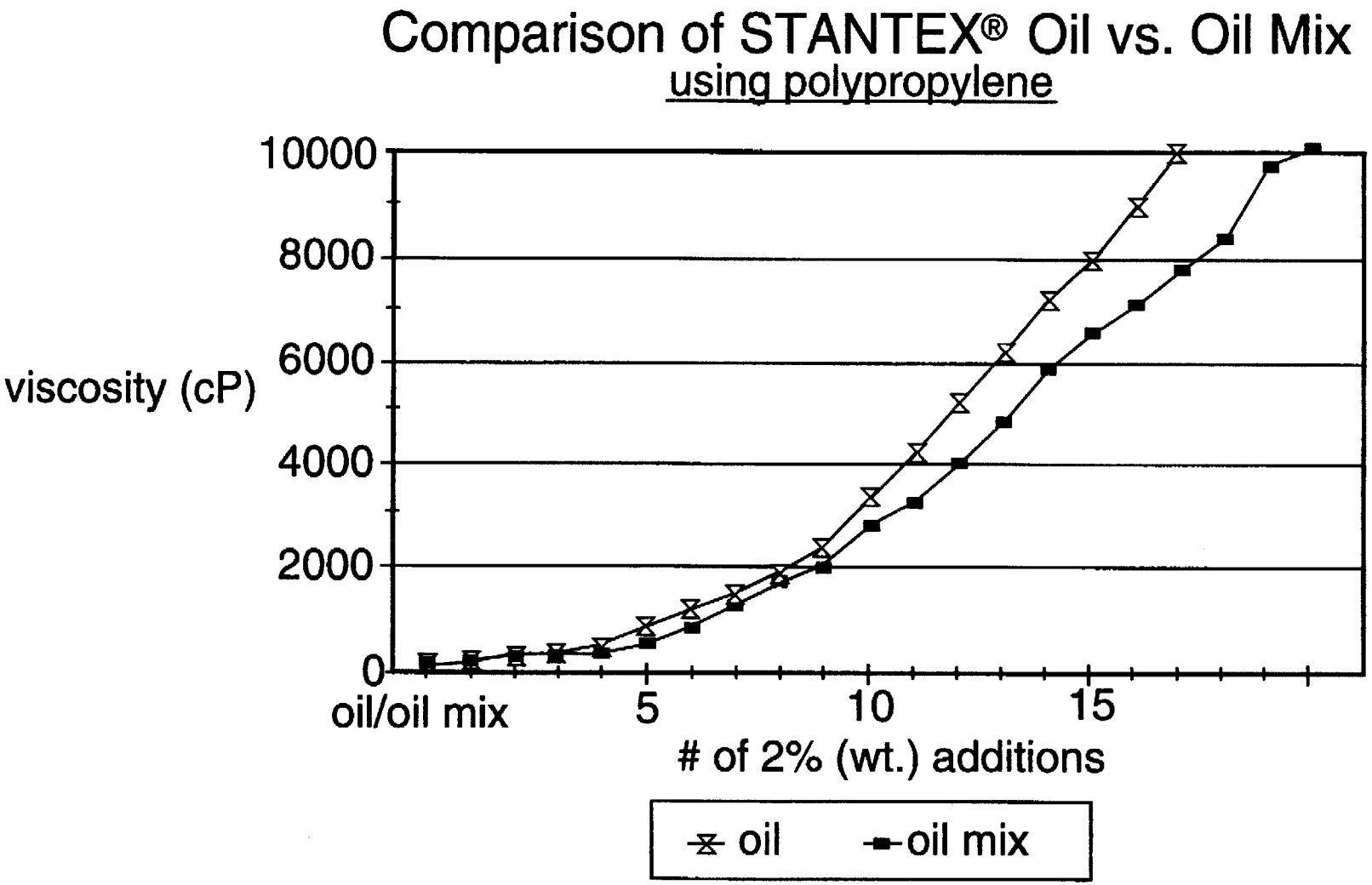
FIG. 2 is a graph depicting the viscosity of yet another embodiment of the present invention in the presence of polypropylene.

The same experiment as example 3 was performed except that CF-0802 oil was used in place of the STANTEX® 0332. CF-0802 oil is a synthetic oil polymer of ethylene oxide/propylene oxide manufactured by Henkel Corporation. The results are listed in Table 2 and graphed in FIG. 2.

TABLE 2

| Sample Addition | 2% wt(g) pP | Oil/pP visc. (cP) | 2% wt(g) pP | Oil(mix)/pP visc.(cP) |
|---|---|---|---|---|
| Oil/oil mix | — | 60.1 | — | 30.1 |
| 1 | 1.0181 | 75.2 | 1.0734 | 40.1 |
| 2 | 1.0487 | 95.2 | 1.0101 | 55.1 |
| 3 | 1.0227 | 130 | 1.0266 | 75.2 |
| 4 | 1.0184 | 155 | 1.0183 | 85.2 |
| 5 | 1.0149 | 204 | 1.062 | 150 |
| 6 | 1.0259 | 326 | 1.002 | 200 |
| 7 | 1.0045 | 429 | 1.0501 | 265 |
| 8 | 1.0231 | 589 | 1.085 | 388 |
| 9 | 1.001 | 736 | 1.051 | 445 |
| 10 | 1.004 | 927 | 1.0327 | 596 |
| 11 | 1.0155 | 1190 | 1.084 | 782 |
| 12 | 1.0078 | 1330 | 1.0885 | 843 |
| 13 | 1.0057 | 1741 | 1.0017 | 1040 |
| 14 | 1.003 | 2300 | 1.0225 | 1140 |
| 15 | 1.0187 | 2670 | 1.0248 | 1280 |
| 16 | 1.0566 | 2970 | 1.0954 | 1560 |
| 17 | 1.0633 | 3390 | 0.9437 | 1820 |
| 18 | 1.0655 | 3770 | 1.0035 | 2430 |
| 19 | 1.0029 | 4110 | 1.0664 | 2740 |
| 20 | 1.0342 | 4780 | 1.0008 | 3210 |
| 21 | 1.0582 | 5000 | 1.0624 | 3850 |
| 22 | — | | 1.0035 | 4430 |
| 23 | — | | 1.017 | 4930 |
| 24 | — | | 1.0278 | 5000 |

Example 5

One hundred (100) grams of STANTEX® 0332 lubricating oil and 40 grams of NMP were added to a 250 ml beaker and stirred (magnetic stirrer at medium speed). As in examples 2 and 3 above, 40 grams of water were and blend to the STANTEX® 0332/NMP blend. However, the samples were maintained at a temperature of 39° C. A straight STANTEX® blend was also heated up to 39° C. Viscosity readings were taken for each sample.

Figure 3:
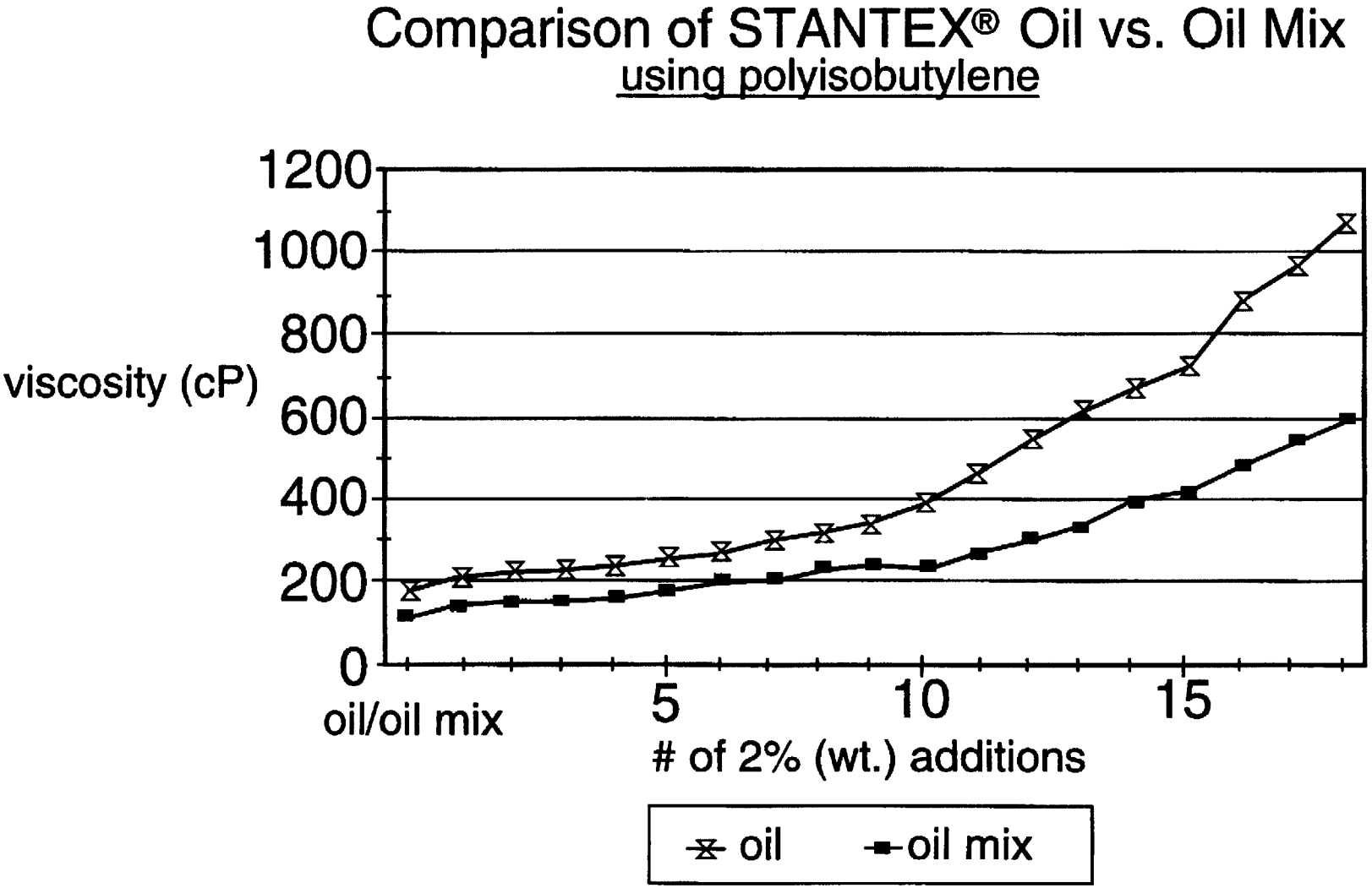
FIG. 3 is a graph of the invention depicting the viscosity of an embodiment of the present invention at 39° C.

Finely ground high molecular weight polyethylene dust was added to the solutions in 2% increments. The results as shown in FIG. 3 show that at the point where the straight STANTEX® 0332 oil gelled, the mixture was still a flowing liquid.

Example 6

Figure 4:
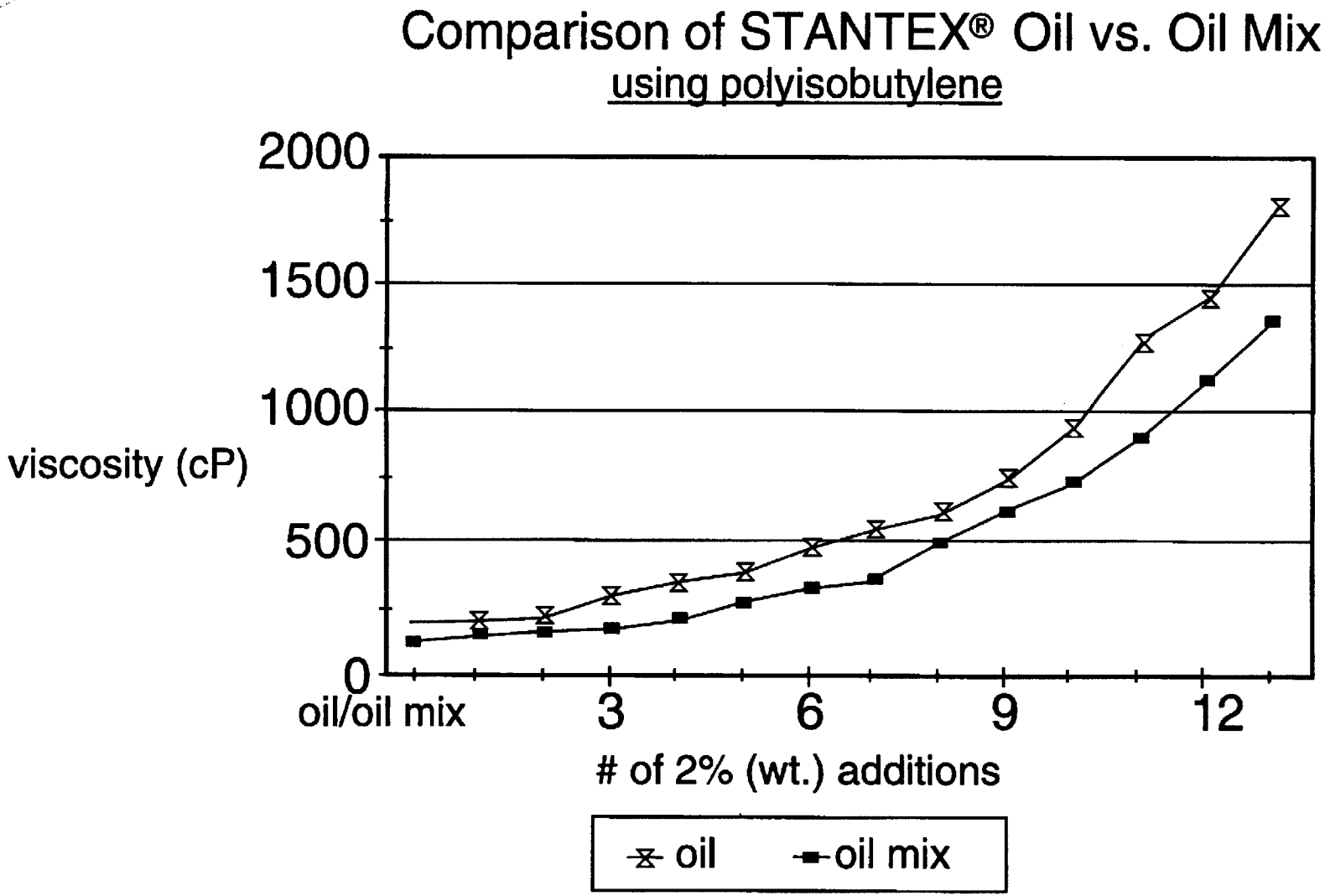
FIG. 4 is a graph of the invention depicting the viscosity of an embodiment of the present invention wherein the polyolefin used is polybutylene.

The procedure was carded out as described in Example 4 except that polybutylene dust was used. Similarly, as shown in FIG. 4, the mixture was still a flowing liquid at the point where the straight oil gelled.

The invention has been described with reference to various specific embodiments. However, many variations and modifications may be made while remaining within the scope of the invention.

I claim:

1. A solution comprising a hydrophobic lubricant, selected from a polyolefin processing lubricant or a polyolefin fiber weaving lubricant, and an alkyl or alkoxy substituted pyrrolidone.

2. The solution as recited in claim 1 wherein the amount by weight of the hydrophobic lubricant ranges from about 10% to about 99% and the amount by weight of the alkyl or alkoxy substituted pyrrolidone ranges from about 90% to about 1%.

3. The solution as recited in claim 1 wherein the amount by weight of the hydrophobic lubricant ranges from about 25% to about 76% and the amount by weight of the alkyl or alkoxy substituted pyrrolidone ranges from about 75% to about 24%.

4. The solution as recited in claim 1 wherein the amount by weight of the hydrophobic lubricant ranges from about 55% to about 65% and the amount by weight of the alkyl or alkoxy substituted pyrrolidone ranges from about 35% to about 45%.

5. The solution as recited in claim 1 further comprising water.

6. The solution as recited in claim 2 further comprising water.

7. The solution as recited in claim 3 further comprising water.

8. The solution as recited in claim 4 further comprising water.

9. The solution as recited in claim 5, wherein the amount by weight of the hydrophobic lubricant ranges from about 25% to about 76%; the amount by weight of water ranges from about 40% to about 5%; and the amount by weight of the alkyl or alkoxy substituted pyrrolidone ranges from about 40% to about 5%.

10. The solution as recited in claim 5, wherein the amount by weight of the hydrophobic lubricant ranges from about 55% to about 65%; the amount by weight of water ranges from about 10% to about 25%; and the amount by weight of the alkyl or alkoxy substituted pyrrolidone ranges from about 10% to about 25%.

11. The solution as recited in claim 5, wherein the amount by weight of the alkyl or alkoxy substituted pyrrolidone is about the same amount by weight of water.

12. The solution as recited in claim 1 wherein the alkyl or alkoxy substituted pyrrolidone comprises N-methyl-2-pyrrolidone.

13. The solution as recited in claim 2 wherein the alkyl or alkoxy substituted pyrrolidone comprising N-methyl-2-pyrrolidone.

14. The solution as recited in claim 3 wherein the alkyl or alkoxy substituted pyrrolidone comprises N-methyl-2-pyrrolidone.

15. The solution as recited in claim 4 wherein the solvent alkyl or alkoxy substituted pyrrolidone comprises N-methyl-2-pyrrolidone.

16. The solution as recited in claim 5 wherein the alkyl or alkoxy substituted pyrrolidone comprises N-methyl-2-pyrrolidone.

17. The solution as recited in claim 6 wherein the alkyl or alkoxy substituted pyrrolidone comprises N-methyl-2-pyrrolidone.

18. The solution as recited in claim 7 wherein the alkyl or alkoxy substituted pyrrolidone comprises N-methyl-2-pyrrolidone.

19. The solution as recited in claim 8 wherein the alkyl or alkoxy substituted pyrrolidone comprises N-methyl-2-pyrrolidone.

20. The solution as recited in claim 9 wherein the alkyl or alkoxy substituted pyrrolidone comprises N-methyl-2-pyrrolidone.

21. The solution as recited in claim 10 wherein the alkyl or alkoxy substituted pyrrolidone comprises N-methyl-2-pyrrolidone.

22. The solution as recited in claim 11 wherein the alkyl or alkoxy substituted pyrrolidone comprises N-methyl-2-pyrrolidone.

23. The solution as recited in claim 22 wherein the amount by weight of the N-methyl-2-pyrrolidone is about 17%, the amount by weight of the hydrophobic lubricant is about 66%, and the amount of water by weight is about 17% wherein the total amount of the three components, by weight, is 100%.

24. A self-cleaning lubricant system comprising:

(a) a hydrophobic lubricant selected from a polyolefin processing lubricant or a polyolefin fiber weaving lubricant;

(b) an alkyl or alkoxy pyrrolidone capable of inhibiting an increase in viscosity of the lubricant; and (c) a polyolefin processing machine containing a polyolefin; wherein the lubricant and the alkyl or alkoxy pyrrolidone are mixed with the polyolefin in the machine.

25. The system of claim 24 wherein the machine is a loom comprising a yarn made from the polyolefin.

26. The system of claim 25 wherein the alkyl or alkoxy pyrrolidone comprises N-methyl-2-pyrrolidone.

27. The system of claim 26 wherein the polyolefin is selected from the group consisting of polyethylene, polypropylene and polybutylene.

28. The system of claim 26 wherein the polyolefin yarn comprises polypropylene.

29. The system of claim 27 wherein the polyolefin yarn is polypropylene.

30. The system of claim 28 wherein the amount by weight of the N-methyl-2-pyrrolidone is about 17%; the amount by weight of the water is about 17%; and the amount by weight of the lubricant is about 66% wherein the combined weight of the N-methyl-2-pyrrolidone, the water and the lubricant is about 100%.

31. The system of claim 24 wherein the water soluble solvent comprises N-methyl-2-pyrrolidone.

32. The system of claim 24 wherein the polyolefin is selected from the group consisting of polyethylene, polypropylene and polybutylene.

33. The system of claim 25 wherein the polyolefin is selected from the group consisting of polyethylene, polypropylene and polybutylene.

34. A method for inhibiting an increase in viscosity in a mixture of a polyolefin and processing lubricant comprising:

(a) adding an alkyl or alkoxy pyrrolidone to a polyolefin wherein the alkyl or alkoxy pyrrolidone is capable of inhibiting an increase in the viscosity of the polyolefin; and (b) adding a hydrophobic lubricant, selected from a polyolefin processing lubricant or a polyolefin fiber weaving lubricant, to the polyolefin.

35. The method of claim 34 comprising adding the pyrrolidone and the lubricant to a yarn comprised of the polyolefin.

36. The method of claim 34 wherein the alkyl or alkoxy pyrrolidone comprises N-methyl-2-pyrrolidone.

37. The method of claim 36 wherein the polyolefin is selected from the group consisting of polyethylene, polypropylene and polybutylene.

38. The method of claim 36 wherein the polyolefin comprises polypropylene.

39. The method of claim 37 wherein the polyolefin is polypropylene.

40. The method of claim 35 wherein the polyolefin comprises polypropylene.

41. The method of claim 35 wherein the polyolefin is selected from the group consisting of polyethylene, polypropylene and polybutylene.

42. The method of claim 41 wherein the polyolefin is polypropylene.

43. The method of claim 40 wherein the alkyl or alkoxy pyrrolidone comprises N-methyl-2-pyrrolidone.

44. The method of claim 41 wherein the alkyl or alkoxy pyrrolidone comprises N-methyl-2-pyrrolidone.

45. The method of claim 42 wherein the alkyl or alkoxy pyrrolidone comprises N-methyl-2-pyrrolidone.

46. The method of claim 35 wherein the alkyl or alkoxy pyrrolidone comprises N-methyl-2-pyrrolidone.

47. The method of claim 34 wherein the polyolefin comprises polypropylene.

48. The method of claim 34 wherein the polyolefin is selected from the group consisting of polyethylene, polypropylene and polybutylene.

49. The method of claim 48 wherein the polyolefin is polypropylene.

* * * * *